US007856828B2

(12) United States Patent
Bunel et al.

(10) Patent No.: US 7,856,828 B2
(45) Date of Patent: Dec. 28, 2010

(54) FLAMEHOLDER ARM FOR AN AFTERBURNER

(75) Inventors: Jacques Marcel Arthur Bunel, Fresnes (FR); Nicolas Pierre-Marie Girard, Paris (FR)

(73) Assignee: SNECMA, Paris (FR)

( * ) Notice: Subject to any disclaimer, the term of this patent is extended or adjusted under 35 U.S.C. 154(b) by 591 days.

(21) Appl. No.: 11/693,177

(22) Filed: Mar. 29, 2007

(65) Prior Publication Data

US 2007/0227151 A1 Oct. 4, 2007

(30) Foreign Application Priority Data

Mar. 30, 2006 (FR) ..... 06 02742

(51) Int. Cl.
*F02K 3/10* (2006.01)

(52) U.S. Cl. ..... 60/763; 60/762; 60/765; 60/766; 60/749; 60/800

(58) Field of Classification Search ..... 60/763, 60/765, 766, 762, 749, 800
See application file for complete search history.

(56) References Cited

U.S. PATENT DOCUMENTS

| | | | | |
|---|---|---|---|---|
| 3,698,186 | A | 10/1972 | Beane et al. | |
| 3,934,409 | A * | 1/1976 | Quillevere et al. | 60/749 |
| 5,396,761 | A * | 3/1995 | Woltmann et al. | 60/39.827 |
| 7,370,477 | B2 * | 5/2008 | Roche et al. | 60/761 |
| 2005/0252216 | A1 * | 11/2005 | Roche et al. | 60/765 |

FOREIGN PATENT DOCUMENTS

| | | |
|---|---|---|
| EP | 1 619 441 A1 | 1/2006 |
| FR | 2 709 342 | 3/1995 |

* cited by examiner

*Primary Examiner*—Michael Cuff
*Assistant Examiner*—Craig Kim
(74) *Attorney, Agent, or Firm*—Oblon, Spivak, McClelland, Maier & Neustadt, L.L.P.

(57) ABSTRACT

A flameholder arm for an afterburner of a turbomachine, particularly a jet engine, is disclosed. The arm includes a ventilation duct which is centered and immobilized inside the arm independent of the heatshield. The duct also includes a transverse lip which includes an orifice for centering and guiding a fuel injection harness. The transverse lip prevents the harness from being positioned in any way incorrectly in the arm.

13 Claims, 2 Drawing Sheets

FLAMEHOLDER ARM FOR AN AFTERBURNER

BACKGROUND OF THE INVENTION AND DESCRIPTION OF THE PRIOR ART

The present invention relates to a flameholder arm of an afterburner in a turbomachine such as a jet engine.

In the conventional way, an afterburner comprises a series of flameholder arms each of which is formed of a hollow dihedron the tip of the vertex of which is directed toward the upstream end of the afterburner and which is closed at the downstream end by a heatshield. A fuel injection harness extends radially inside the arm from an outer casing of the afterburner. This injection harness is connected to fuel supply means and comprises holes for spraying fuel.

A ventilation duct extends in the arm substantially parallel to the fuel injection harness, between the latter and the tip of the dihedron of the arm and comprises at its radially outermost end an opening for picking up cooling air intended to be diffused into the arm through holes in the duct. The radially innermost end of the ventilation duct is closed and comprises a centering finger engaged in an orifice in the arm.

The ventilation duct also comprises, near its radially innermost end, a stud projecting downstream and the free end of which is engaged in a corresponding orifice in the heatshield in order to hold the ventilation duct in place. An orifice formed in the stud accommodates the lower end of the fuel injection harness in order to center it in the arm.

During assembly, the arm is assembled with the ventilation duct and the heatshield which is fixed to the arm by means of stepped welded pins and which immobilizes the ventilation duct. Next, the fuel injection harness is mounted in the arm from the outer casing of the afterburner, by engaging its radially innermost end between the heatshield and the ventilation duct to the point where this end becomes housed in the centering orifice formed in the stud of the duct.

However, this operation is performed blind, and this means there is a risk that the injection harness might be fitted incorrectly with its internal end engaged in an empty space between the stud and a side wall of the arm. This results in poor distribution of the fuel sprayed into the arm and degrades the cooling of the arm, leading to possible destruction of the heatshield.

In operation, the ventilation duct is subjected to significant vibrations which cause frictional wear of its stud and of the corresponding orifice in the heatshield, something which results in the duct shifting inward and in the finger of the duct protruding into the main air stream, and results in wear and enlargement of the orifice in the arm which accepts the duct centering finger.

The inward shift of the ventilation duct may cause the fuel injection harness to disengage from the orifice in the stud and may cause the harness to break.

SUMMARY OF THE INVENTION

It is a particular object of the invention to provide a simple, effective and economical solution to all of these problems.

To this end, the invention proposes a flameholder arm for an afterburner comprising a body in the form of an open dihedron, a ventilation duct extending inside the body and comprising, at one end, a centering finger engaged in an orifice in the body, a fuel injection harness extending inside the body along the ventilation duct, means for guiding and centering the harness with respect to the duct and a heatshield fixed to the body and closing the open face of the dihedron, wherein the ventilation duct comprises means of immobilization in the body of the arm which are independent of the heatshield.

Thus, the ventilation duct is centered and immobilized in the flameholder arm independently of the heatshield which means that the centering and attachment stud provided on the duct in the prior art can be dispensed with.

At the same time it is possible also to eliminate:

- the wear of the heatshield which resulted from vibrations of this stud in the receiving orifice formed in the shield,
- the wear of the centering finger in the orifice formed in the body of the arm and corresponding wear of the edges of this orifice,
- the risk of the fuel injection harness breaking as a result of disengagement of the centering and guide means formed on the ventilation duct.

According to another characteristic of the invention, the duct centering finger passes through the orifice formed in the body of the arm and comprises the means for immobilizing the duct on the body of the arm.

In a preferred embodiment of the invention, these immobilizing means comprise an annular shoulder formed on the centering finger and intended to come to bear against the edge of the orifice in the body of the arm, on the inside of the arm, and means of retaining the finger in this orifice, these means being formed at the end of the finger external to the arm, these retaining means comprising an annular component fixed by brazing or welding to the duct centering finger.

As a preference, the shoulder of the centering finger is pressed against the body of the arm by the annular component which is fixed to the end of this finger, on the outside of the arm.

Thus, the duct is fixed without play onto the body of the arm and radial vibrations of the duct with respect to the body of the arm are avoided.

Provision may also be made for this annular component to comprise at least one flat collaborating, by butting against it, with a corresponding element of the body of the arm in order to contribute to the rotational immobilization of the duct relative to the arm.

According to another characteristic of the invention, the ventilation duct also comprises a transverse lip which comprises an orifice for centering the fuel injection harness and which occupies almost all of the available space inside the arm, so as to prevent the fuel injection harness from being fitted incorrectly.

The presence of this transverse lip inside the body of the arm prevents the end of the fuel injection harness from being fitted anywhere other than in the centering orifice formed in this lip.

Thus, the blind fitting of the fuel injection harness inside the body of the arm can no longer result in an incorrect layout of the fuel injection harness and avoids the risk of wear and damage to the harness and to the body of the arm.

The invention also proposes a ventilation duct of a flameholder arm comprising an open end and an end formed with a substantially axial finger, wherein this finger has an annular shoulder for bearing against a support.

This ventilation duct is also one which is formed with a transverse lip comprising a through-orifice the axis of which is substantially parallel to the longitudinal axis of the duct.

The invention also relates to a turbomachine, such as an airplane jet engine, and which comprises at least one flameholder arm of the type described in the foregoing.

The invention will be better understood and other details, characteristics and advantages of the present invention will become apparent from reading the following description given by way of nonlimiting example and with reference to the attached drawings in which.

Figure 1:
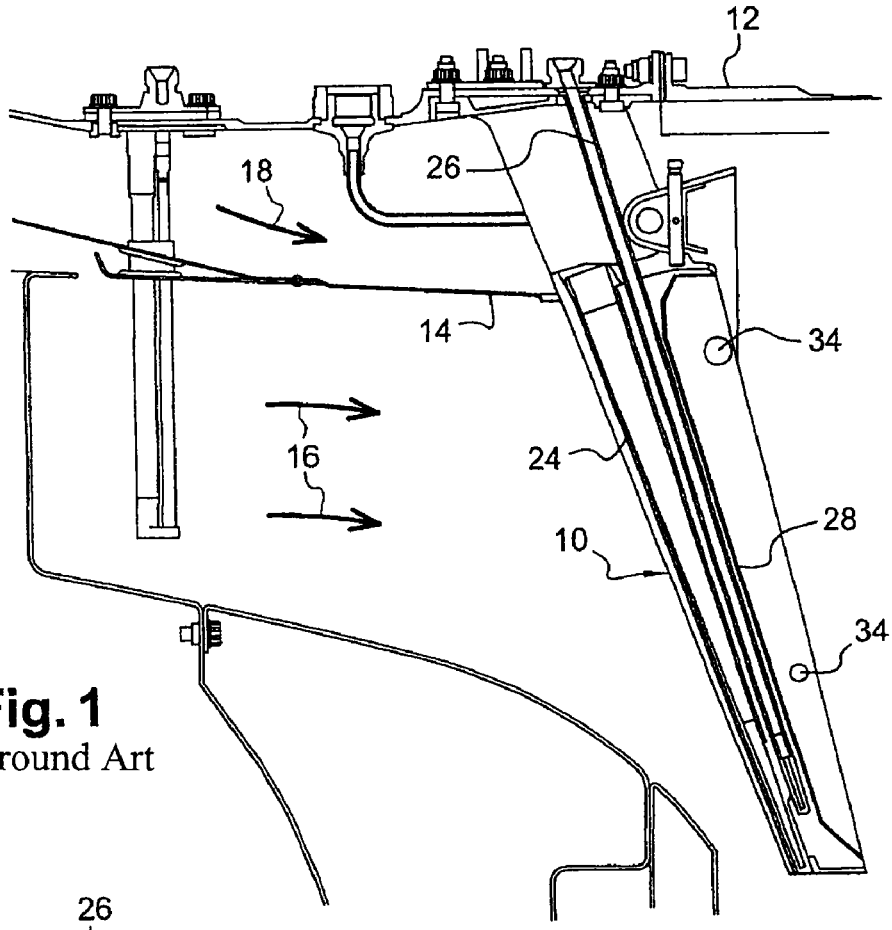
Fig. 1 Background Art
FIG. 1 is a partial schematic view in axial section of a turbomachine afterburner.
Figure 2:
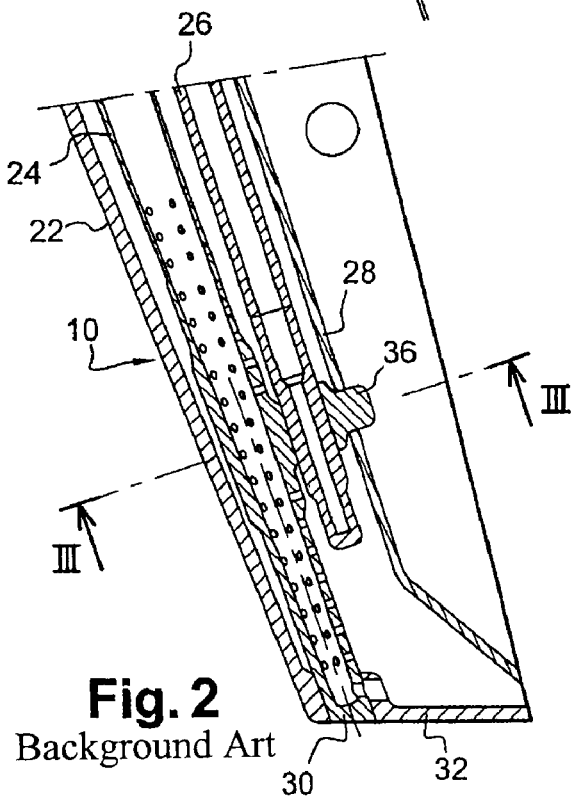
Fig. 2 Background Art
FIG. 2 is a view on a larger scale of part of a flameholder arm of FIG. 1 and illustrates a device for fixing a ventilation duct in the flameholder arm according to the prior art.
Figure 3:
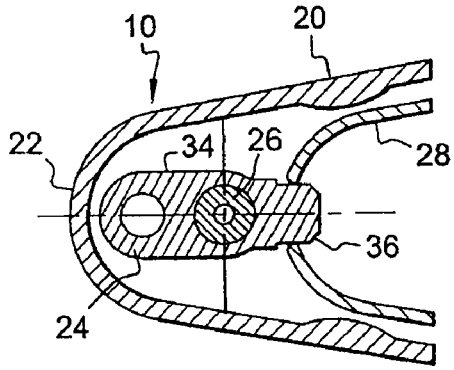
Fig. 3 Background Art
FIG. 3 is a view in section on III-III of FIG. 2, on a larger scale.

Reference is made first of all to FIGS. 1 to 3 in which a flameholder arm 10 of the prior art is mounted on a casing 12 of a jet engine afterburner, at its radially outermost end, this arm 10 extending substantially radially into the afterburner and passing through a confluence sheet 14 which separates the main air stream 16 of hot combustion gases from the bypass air stream 18 supplied by a fan mounted on the front end of the jet engine.

In the known way, the flameholder arm 10 comprises a body 20 in the form of an open dihedron, the tip of the vertex 22 of which is directed upstream and the opening of which is directed downstream and in which a ventilation duct 24, a fuel injection harness 26 and a heatshield 28 of C-shaped cross section and which closes the open face of the body 22 are mounted.

The ventilation duct 24 extends inside the arm along the tip of the vertex 22 and comprises a radially outermost end which is open and supplied with air from the bypass air stream 18 via an opening in the radially outermost part of the body of the arm. The radially innermost part of the duct 24 comprises multiple perforations for distributing air within the arm.

The radially innermost end of the duct forms a cylindrical finger 30 which is engaged without clearance in an orifice in the base 32 of the body of the arm, the end of the finger 30 lying flush with the exterior face of this base 32 without protruding on the outside of the arm.

Near this radially outermost end, the ventilation duct 24 comprises a lug 34 which extends downstream toward the heatshield 28 in a way substantially perpendicular to the longitudinal axis of the duct 24 and the free end of which forms a stud 36 engaged in a corresponding orifice in the shield 28.

This lug 34 also comprises, in an intermediate part between the ventilation duct 24 and the stud 36, a through-orifice for accommodating the lower part of the fuel injection harness 26 in order to center this harness inside the arm 10.

On assembly, the ventilation duct 24 is first of all positioned in the body 20 of the arm 10, then the heatshield 28 is fitted, the stud 36 of the ventilation duct being engaged in the orifice in the shield, then the shield 28 is fixed by welding at four points 34 to the side walls of the body 20 of the arm, thus fixing the ventilation duct 24 inside the arm. The fuel injection harness 26 is then mounted blind inside the arm from the radially outermost end thereof. This operation demands particular care because the lower end of the fuel injection harness 26 needs to be engaged in the orifice provided in the lug 34 of the ventilation duct 24 rather than between this lug 34 and a side wall of the body 20 of the arm 10.

In operation, the ventilation duct 24 is subjected to radial vibrations inside the arm 10 and this results in wear of its stud 36 and of the edges of the corresponding orifice in the heatshield 28 and in wear of the finger 30 of its radially innermost end and of the edges of the corresponding orifice formed in the base 32 of the arm 10.

This wear results in the duct 24 dropping down inside the arm 10, the end of the finger 30 ultimately protruding under the base 32 of the arm 10 and disturbing the afterburn conditions. In addition, this shifting of the ventilation duct 24 in the arm 10 may allow the radially innermost end of the fuel injection harness 26 to become dislodged from its guide orifice formed in the lug 34 of the ventilation duct, thus causing the fuel injection harness 26 to break.

Figure 4:
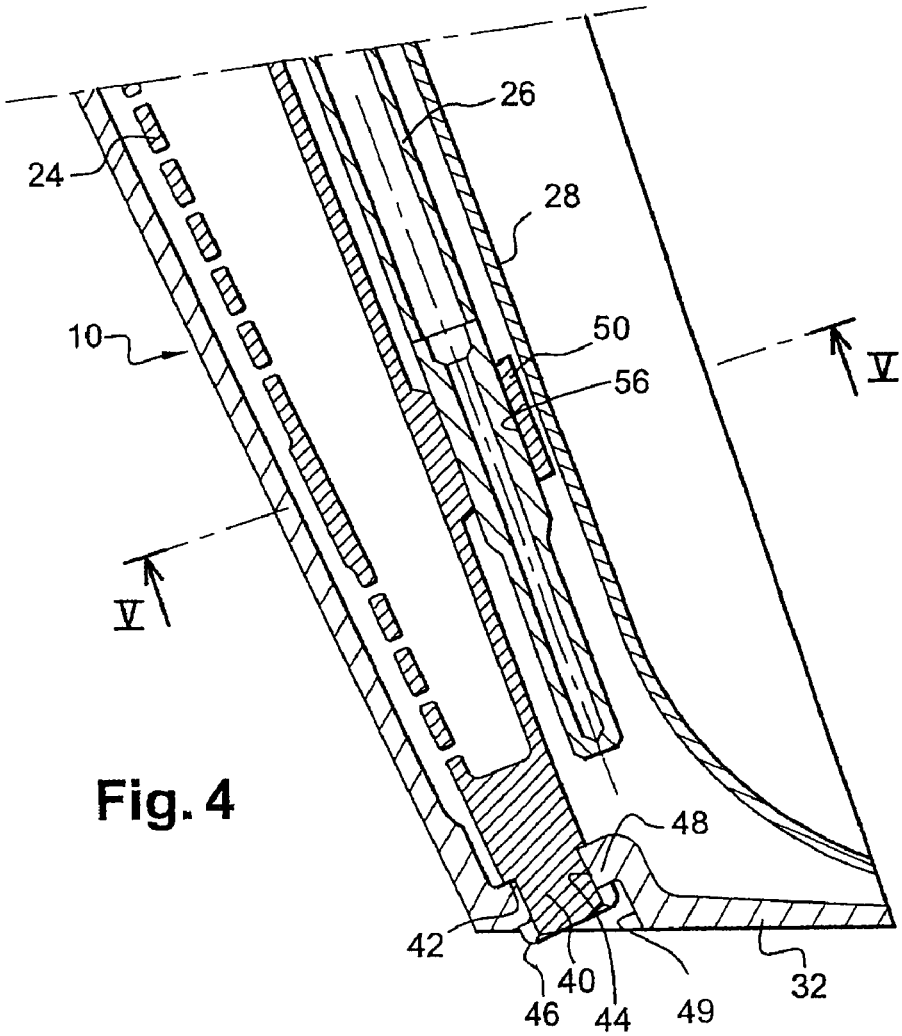
FIG. 4 is a view corresponding to FIG. 2 but illustrates a fixing device according to the invention.
Figure 5:
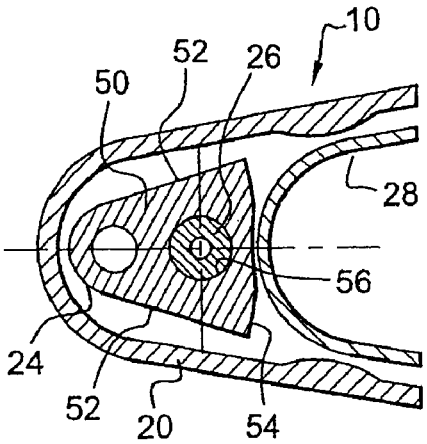
FIG. 5 is a view in section on V-V of FIG. 4, on a larger scale.
Figure 6:
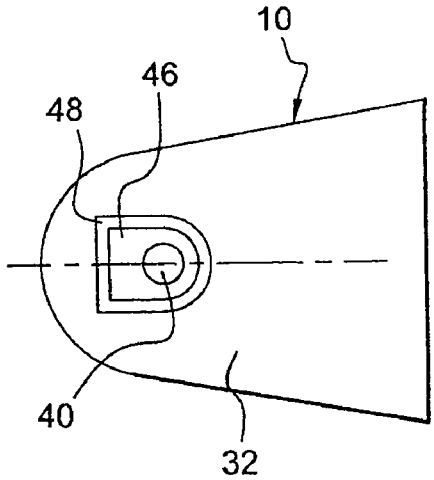
FIG. 6 is a view from beneath of the arm of FIG. 4.

To avoid these disadvantages, the invention proposes for the ventilation duct 24 to be mounted and fixed inside the arm 10 independently of the heatshield 28, as has been depicted in FIGS. 4 to 6.

In these figures, the radially innermost end of the ventilation duct 24 comprises a cylindrical finger 40 which extends along the axis of the duct 24 and comprises an annular shoulder 42 forming a surface for bearing against the edge of the orifice 44 formed in the base 32 of the arm 10, the cylindrical finger 40 extending on the outside of this orifice and bearing an annular component 46, such as a washer for example, which is fixed, for example by welding or brazing, to the end of the finger 40.

Advantageously, the orifice 44 is formed in the end wall 48 of a small indentation 49 in the base 32 of the arm 10, this end wall 48 being perpendicular to the axis of the duct 24 and of the finger 40.

When this indentation 48 is not of cylindrical shape, as depicted schematically in FIG. 6, the annular component 46 may be given a corresponding shape so that this annular component has a function of preventing the rotation of the finger 40 and therefore of the duct 24 about their longitudinal axis.

It is also possible to make one or two flats in the contour of the annular component 46, this flat or these flats corresponding to flat faces of the indentation 48 in order to provide the annular component 46 with this rotation-proofing function.

As can be clearly seen in FIGS. 4 and 5, the ventilation duct 24 no longer has the stud 36 engaged in an orifice in the heatshield 28 and the lug 34 depicted in FIG. 1 is replaced by a transverse lip 50 of the duct 24, this lip 50 being in the form of an angular sector and extending inside the body 20 of the arm 10 in such a way as to occupy, in a transverse plane, most of the available space inside the arm 10 between the duct 24 and the heatshield 28.

In the example depicted, the sides 52 and 54 of the lip 50 are more or less parallel to the side walls of the arm 10 and of the shield 28, respectively, and lie a short distance from these walls, thus preventing the radially innermost end of the fuel injection harness 26 from being mounted anywhere other than in the guide orifice 56 formed in the lip 50. Thus blind fitting of the fuel injection harness 26 in the arm 10 is greatly facilitated and any incorrect placement of the fuel injection harness is avoided while at the same time guaranteeing better at cooling of the arm 10 by the fuel and extending the life of the arm.

Fixing the end finger 40 of the duct 24 in the orifice 44 in the base 32 of the arm 10 axially without clearance prevents radial vibrations of the ventilation duct 24 in the arm and the resulting wear on the arm and on the duct.

Should the heatshield 28 become burnt, the ventilation duct 24 remains held in the arm 10 and continues to perform its function of cooling the various elements of the arm. The fuel injection harness 26 is also held in place on the ventilation duct 24 inside the arm and cannot break.

The invention claimed is:

1. A flameholder arm for an afterburner, comprising:

a body in the form of an open dihedron, the body including a base disposed at a radially innermost end of the body and an orifice which is disposed in the base of the body;

a ventilation duct which extends inside the body and includes a centering finger at a radially innermost end of the ventilation duct which is engaged in the orifice disposed in the base of the body and a transverse lip which extends inside the body of the arm towards an open face of the dihedron;

a fuel injection harness which extends inside the body along the ventilation duct, and a heatshield fixed to the body and which closes the open face of the dihedron, wherein the ventilation duct is immobilized in the body of the arm independent of the heatshield, wherein the transverse lip includes a guide orifice which centers the fuel injection harness, and wherein a space is provided between the transverse lip and the heatshield.

2. The arm as claimed in claim 1, wherein the ventilation duct centering finger passes through the orifice in the body and immobilizes the duct on the body of the arm.

3. The arm as claimed in claim 1, wherein the centering finger comprises an annular shoulder of the centering finger abuts against the edge of the orifice in the body of the arm on the inside of the arm.

4. The arm as claimed in claim 2, wherein the radially innermost end of the finger which extends externally from the arm retains the centering finger in the orifice.

5. The arm as claimed in claim 4, wherein an annular component is fixed by brazing or welding to the radially innermost end of the centering finger.

6. The arm as claimed in claim 5, wherein a shoulder of the centering finger is pressed against the arm by the annular component fixed to the radially innermost end of the centering finger.

7. The arm as claimed in claim 5, wherein the annular component comprises at least one flat which cooperates with a corresponding element of the arm in order to prevent the finger from rotating in the orifice.

8. The arm as claimed in claim 1, wherein the transverse lip of the duct occupies almost all of the available space inside the arm so as to prevent the fuel injection harness from being fitted incorrectly.

9. The arm as claimed in claim 1, wherein the ventilation duct is formed as a single piece with the finger and the transverse lip.

10. A ventilation duct of a flameholder arm comprising:

a first end which is open; and a second end opposite the first end formed with a substantially axial finger; and a transverse lip including a through-orifice with an axis substantially parallel to an axis of the duct, wherein the finger includes an annular shoulder which bears against a support, and wherein the axial finger is circular, and wherein a space is provided between the transverse lip and a heatshield disposed in the flameholder arm.

11. A turbomachine, such as an airplane jet engine, and which comprises at least one flameholder arm as claimed in claim 1.

12. The arm as claimed in claim 1, wherein the orifice is formed in an end wall of a small indentation in the base of the body, and the end wall is perpendicular to an axis of the ventilation duct.

13. The arm as claimed in claim 1, wherein the traverse lip is an angular sector and a space is provided between side walls of the traverse lip and side walls of the body of the arm.

* * * * *